US006712431B1

(12) United States Patent
Bosch et al.

(10) Patent No.: US 6,712,431 B1
(45) Date of Patent: Mar. 30, 2004

(54) CUTTING ARRANGEMENT

(75) Inventors: Neill Jonathan Bosch, Morehill (ZA); Robert Hugh Bosch, Rynfield (ZA); Johannes Hendrikus Oosthuizen, Surrey Road (ZA)

(73) Assignee: Genesis Mining Technologies (Pty) Limited (ZA)

( * ) Notice: Subject to any disclaimer, the term of this patent is extended or adjusted under 35 U.S.C. 154(b) by 0 days.

(21) Appl. No.: 09/857,750

(22) PCT Filed: Dec. 6, 1999

(86) PCT No.: PCT/IB99/01935

§ 371 (c)(1),
(2), (4) Date: Oct. 19, 2001

(87) PCT Pub. No.: WO00/34626

PCT Pub. Date: Jun. 15, 2001

(30) Foreign Application Priority Data

Dec. 8, 1998 (ZA) ..... 98/11208

(51) Int. Cl.[7] ..... E21C 35/18; E21C 35/197
(52) U.S. Cl. ..... 299/104; 299/110; 299/106
(58) Field of Search ..... 299/79.1, 104, 299/106, 107, 110, 111, 113

(56) References Cited

U.S. PATENT DOCUMENTS

| | | | | |
|---|---|---|---|---|
| 3,397,013 A | | 8/1968 | Krekeler | |
| 3,499,685 A | * | 3/1970 | Kniff | 299/104 |
| 3,830,321 A | | 8/1974 | McHenry et al. | 175/332 |
| 3,830,546 A | * | 8/1974 | Kniff | 299/107 |
| 4,333,687 A | * | 6/1982 | Barnstorf | 299/81.2 |
| 4,978,173 A | * | 12/1990 | Rothkegel | 299/81.1 |
| 5,302,005 A | * | 4/1994 | O'Neill | 299/87.1 |

FOREIGN PATENT DOCUMENTS

| | | |
|---|---|---|
| DE | 94 11 438 | 11/1994 |
| DE | 196 11 455 | 9/1996 |
| EP | 0 573 135 | 12/1993 |
| GB | 2 196 669 | 5/1988 |

OTHER PUBLICATIONS

Pilkey, Walter; "formulas for Stress, Strain, and Structural Matrices", 1995; John Wiley and Sons; pp 243, 250, 252, 253, 255.*

International Search Report, Form PCT/ISA/210, as issued by European Patent Office in connection with PCT Appl. No. PCT/IB99/01935.

* cited by examiner

*Primary Examiner*—Heather Shackelford
*Assistant Examiner*—John Kreck
(74) *Attorney, Agent, or Firm*—Quarles & Brady LLP

(57) ABSTRACT

A cutting arrangement (10) includes a pick holder (12) having a bore (14) containing a sleeve (16) within which a shank (18) of a pick (20) is located. The pick (20) and the sleeve (16) each have heads (22; 24). The head (24) of the sleeve (16) has an outer abutting surface (26) and an inner abutting surface (30). The outer abutting surface (26) abuts an abutting surface (28) of the head (22) of the pick (20). The inner abutting surface (30) abuts an abutting surface (32) of the pick holder (12). The abutting surface (28) of the head (22) of the pick (20) has an outwardly curved formation (28.1) which abuts an inwardly curved formation (26.1) on the outer abutting surface (26) of the sleeve (16). The inner abutting surface (30) on the head (24) of the sleeve (16) has an outwardly curved formation (30.1). The abutting surface (32) of the pick holder (12) has an inwardly curved formation (32.1). The inwardly and outwardly curved formations (30.1; 32.1) abut one another.

27 Claims, 7 Drawing Sheets

110.1

118.1
120.1
112.1
114.1

126.1
122.1
112.1
114.1

124.1
128.1
120.1
116.1
118.1

FIG 8
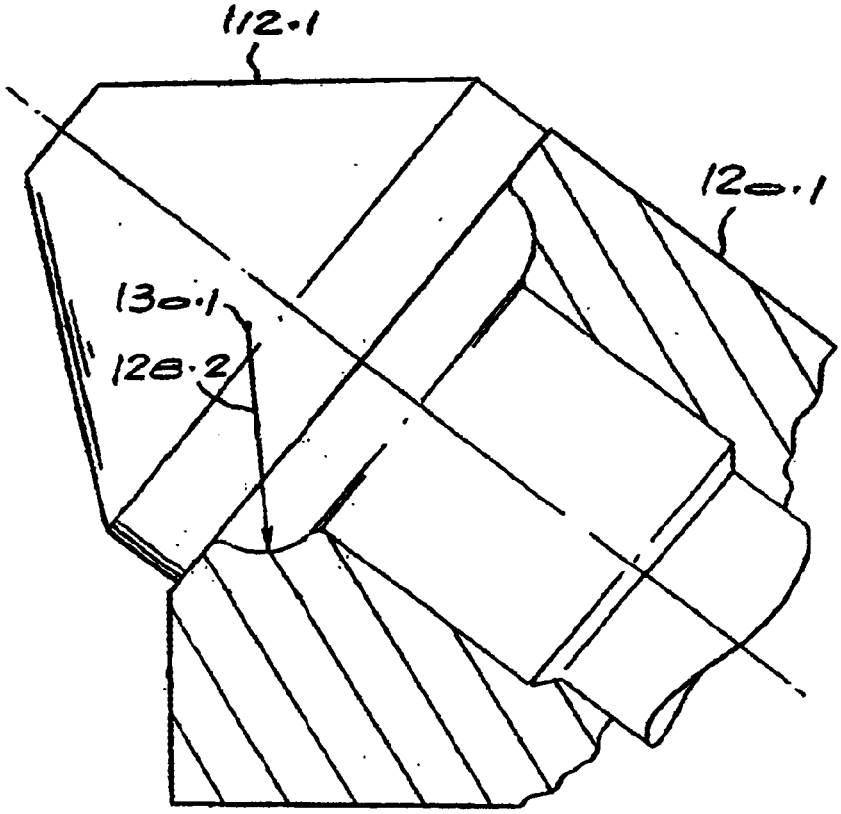
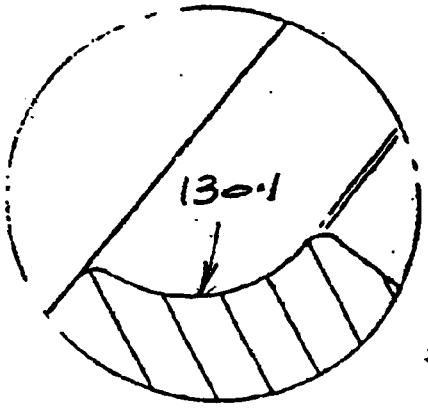
FIG 9

CUTTING ARRANGEMENT

FIELD OF THE INVENTION

This invention relates to a cutting arrangement for a machine.

SUMMARY OF THE INVENTION

According to the invention a cutting arrangement includes a pick holder having a bore containing a sleeve within which a shank of a pick is located, with the pick and the sleeve each having heads, the head of the sleeve having an outer abutting surface and an inner abutting surface, the outer abutting surface abuts an abutting surface of the head of the pick and the inner abutting surface abuts an abutting surface of the pick holder, with the abutting surface of the head of the pick having a convex formation which abuts a concave formation on the outer abutting surface of the sleeve.

Preferably the inner abutting surface on the sleeve has a convex formation and the abutting surface of the pick holder has a concave formation, with the convex and concave formations abutting one another.

The abutting surface of the head of the pick and the outer abutting surface of the head of the sleeve may include planar surfaces which abut one another.

The inner abutting surface of the head of the sleeve and the abutting surface of the pick holder may include planar surfaces which abut one another.

The shank of the pick and the bore of the sleeve may include retaining formations for retaining the sleeve and the shank within the pick holder if the head of the pick is severed from the shank. The retaining formations may be step formations.

The shank is preferably rotatable within the sleeve and the sleeve is preferably rotatable within the bore of the pick holder. Thus the sleeve is not an interference fit within the bore of the pick holder, but is a sliding fit within the bore of the pick holder.

The sleeve preferably has a tail which abuts a step in the bore of the pick holder, the tail having an inwardly curved formation which abuts an outwardly curved formation on the step.

The pick is preferably retained within the pick holder by a clip releasably secured to the pick.

According to another aspect of the invention a cutting arrangement includes a pick holder having a bore containing a sleeve within which a shank of a pick is located, with the pick and the sleeve each having heads, the head of the sleeve having an outer abutting surface and an inner abutting surface, the outer abutting surface abuts an abutting surface of the head of the pick, and the inner abutting surface abuts an abutting surface of the pick holder, with the inner abutting surface of the head of the sleeve having an outwardly curved formation and the abutting surface of the pick holder having an inwardly curved formation, with the inwardly and outwardly curved formations abutting one another.

According to another aspect of the invention a cutting arrangement includes a pick and a pick holder, the pick having a head with a shank extending therefrom, the head having an abutting surface which abuts an abutting surface of the pick holder, the abutting surface of the head having a convex formation which abuts a concave formation on the abutting surface of the pick holder.

The abutting surfaces of the pick and the pick holder may include planar surfaces which abut one another.

The shank of the pick and the bore of the pick holder may include retaining formations for retaining the shank within the bore if the head is severed from the shank. The retaining formations may be step formations.

According to another aspect of the invention a cutting arrangement includes a pick holder having a bore containing a sleeve within which the shank of a pick is located, with the shank of the pick and the bore of the sleeve having retaining formations for retaining the sleeve and the shank within the pick holder if the head of the pick is severed from the shank.

According to another aspect of the invention a sleeve includes an outer abutting surface for abutting a head of a pick, and an inner abutting surface for abutting a pick holder, the outer abutting surface having an inwardly curved formation for abutting an outwardly curved formation on the head of the pick.

The inner abutting surface may have an outwardly curved formation for abutting an inwardly curved formation on the pick holder.

The sleeve preferably has a tail which abuts a step in the bore of the pick holder, the tail having an inwardly curved formation for abutting an outwardly curved formation on the step.

According to another aspect of the invention a sleeve includes an outer abutting surface for abutting a head of a pick, and an inner abutting surface for abutting a pick holder, the inner abutting surface having an outwardly curved formation for abutting an inwardly curved formation on the pick holder.

According to another aspect of the invention a pick holder includes an abutting surface with a inwardly curved formation for abutting an outwardly curved formation on a sleeve or a pick.

The pick holder preferably has a step in its bore for abutting a tail of the sleeve, the step having an outwardly curved formation for abutting an inwardly curved formation on the tail.

BRIEF DESCRIPTION OF THE DRAWINGS

FIG. 8 is a cross-sectional side view of the pick holder showing the location of the pick in the pick holder;

FIG. 9 is an enlarged view of part of FIG. 8;

DETAILED DESCRIPTION OF THE DRAWINGS

Figure 1:
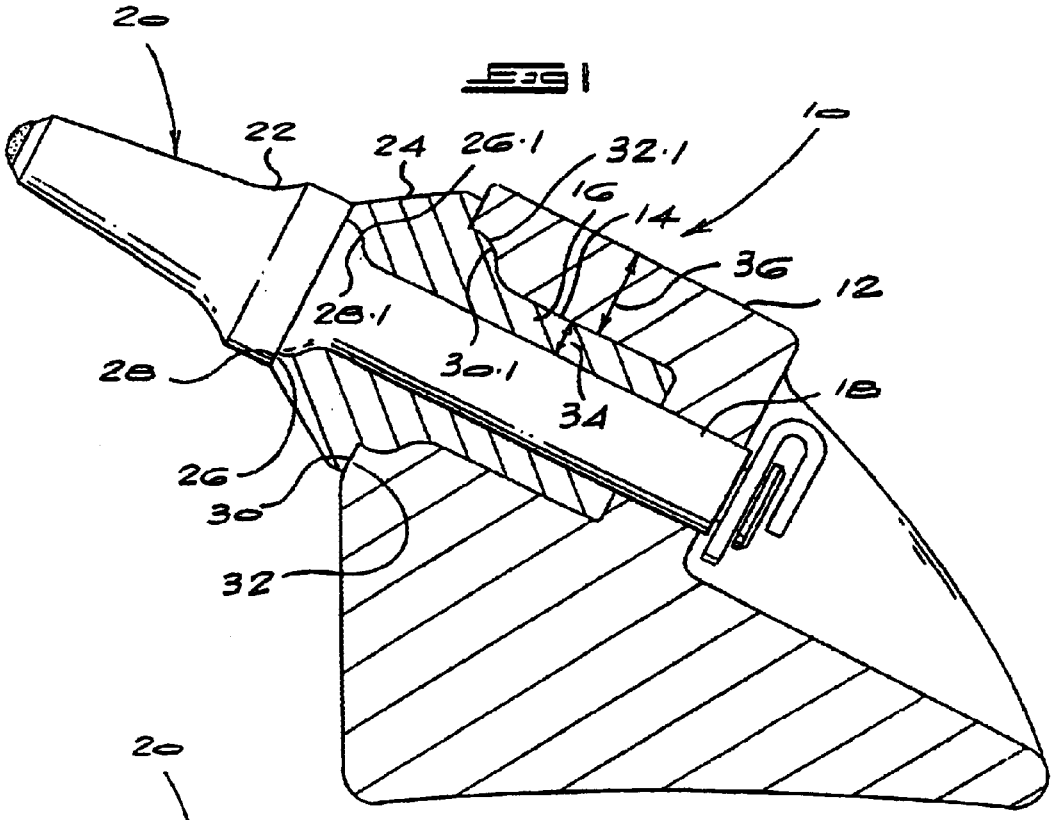
FIG. 1 is a cross-sectional side view of a cutting arrangement according to the invention.

A cutting arrangement 10 for a continuous mining machine (not shown) includes a pick holder 12 having a bore 14 containing a sleeve 16 within which a shank 18 of a pick 20 is located. The pick 20 and the sleeve 16 have heads 22 and 24 respectively.

The head 24 of the sleeve 16 has an outer surface 26 which abuts a surface 28 of the head 22 of the pick 20. Part of these abutting surfaces 26 and 28 have a concave formation 26.1 and a convex formation 28.1 which abut one another. In addition the abutting surfaces 26 and 28 have planar surfaces 27 and 29 which abut one another (see FIGS. 3 and 4).

Likewise an inner surface 30 of the head 24 of the sleeve 16 and an outer surface 32 of the pick holder 12 have a convex formation 30.1 and a concave formation 32.1 which abut one another. In addition to the abutting convex and concave formations, the inner surface 30 has a planar surface 33 which abuts a planar surface 35 on the pick holder 12 (see FIGS. 4 and 5).

Figures 3, 4, 5:
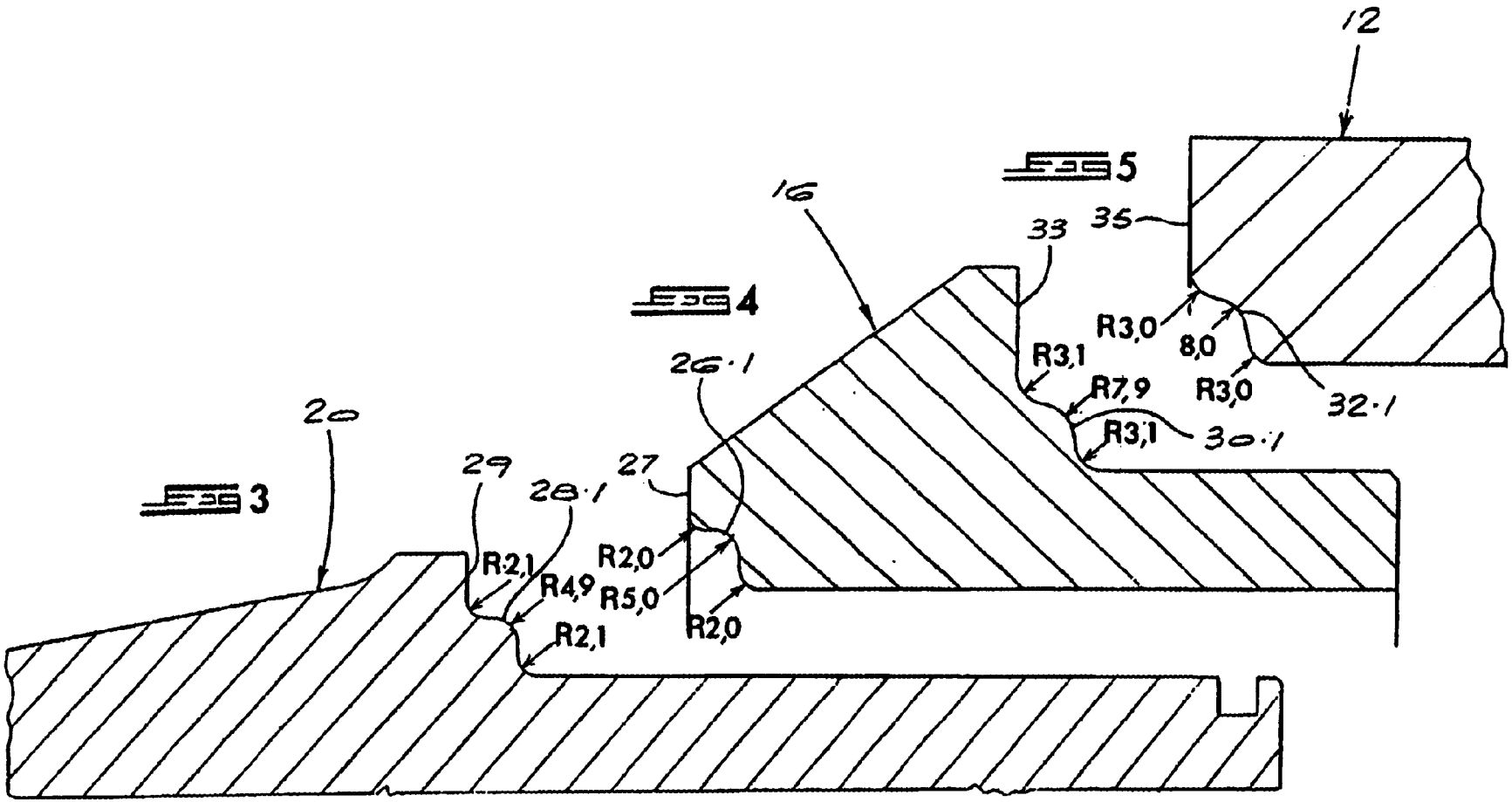
FIG. 3 is an enlarged view of part of the pick showing its curved surfaces.
FIG. 4 is an enlarged view of part of the sleeve showing its curved surfaces.
FIG. 5 is an enlarged view of the pick holder showing its curved surfaces.
Figure 6:
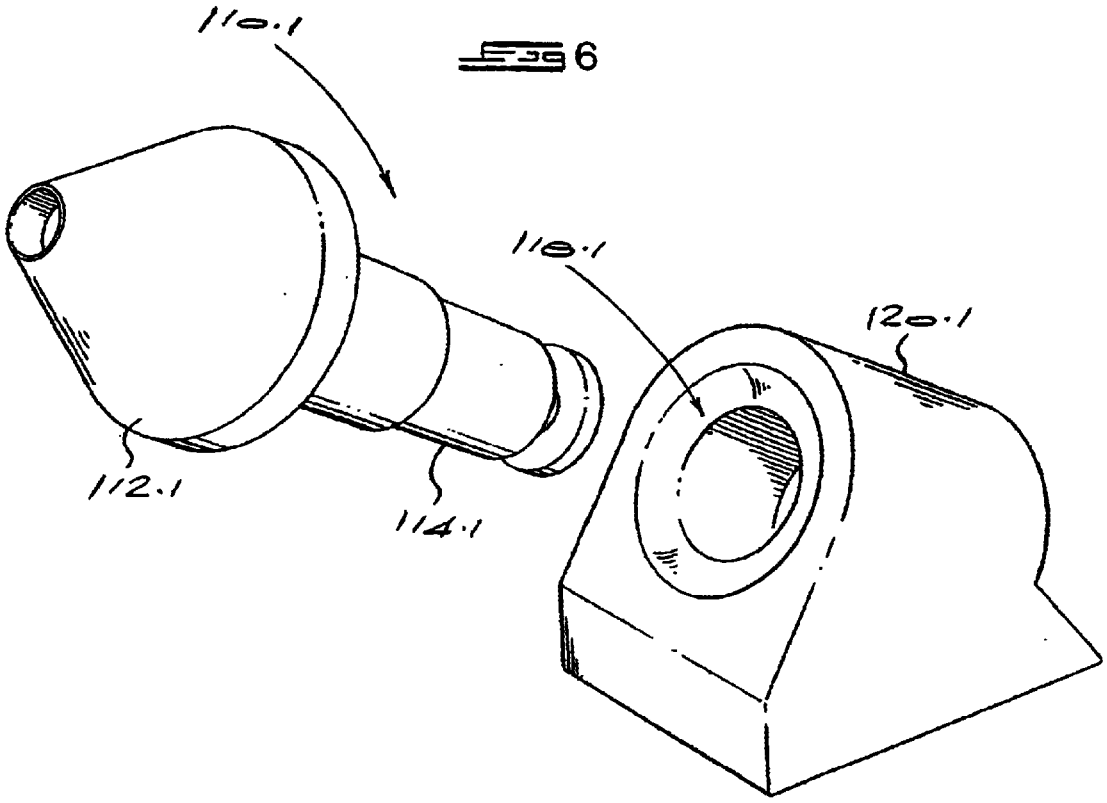
FIG. 6 is an exploded perspective view of a pick and a pick holder according to another embodiment of the invention.
Figure 7:
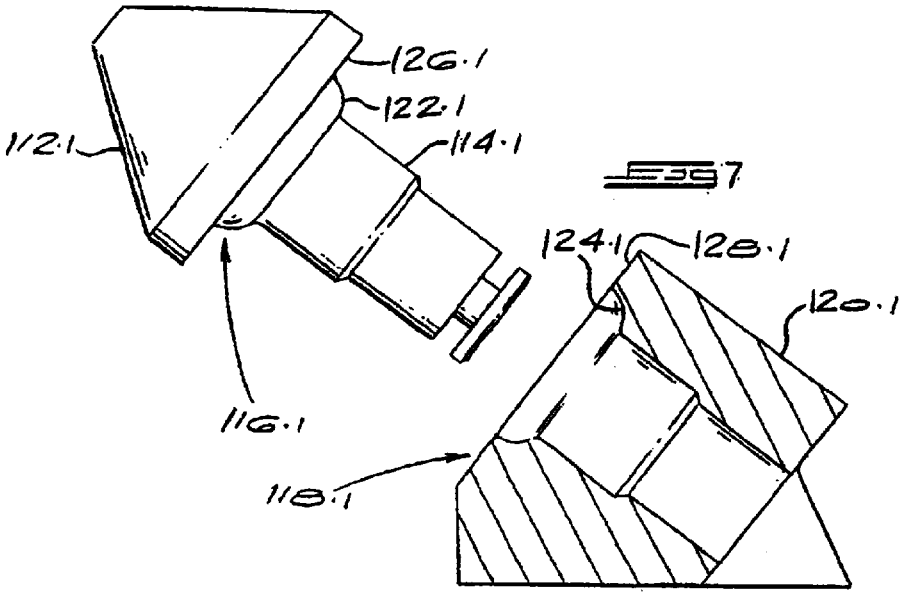
FIG. 7 is a side view of FIG. 6 with the pick holder in cross-section.

FIGS. 3 to 5 show the convex and concave formations and their radiuses of curvature.

The thickness of the sleeve 16, indicated by reference numeral 34, is 7 mm, and the thinnest part of the pick holder 12 surrounding the sleeve 16, indicated by reference numeral 36, is 22 mm.

The sleeve 16 is a sliding fit within the bore 14 of the pick holder 12. Likewise the shank 18 of the pick is a sliding fit within the sleeve 16. Thus the sleeve 16 can rotate relative to the pick holder 12, and the pick 20 can rotate relative to the sleeve 16.

Referring now to FIGS. 6 to 9 a cutting arrangement for a mining machine (not shown) includes a pick 110.1 which has a head 112.1 and a shank 114.1 extending from the head 112.1. The head 112.1 has an abutting surface 116.1 which abuts a abutting surface 118.1 of a pick holder 120.1. the abutting surface 116.1 of the head 112.1 has a circumferentially extending convex formation 122.1. The convex formation 122.1 abuts a circumferentially extending complimentary concave formation 124.1 on the abutting surface 118.1 of the pick holder.

The abutting surface 116.1 of the head 112.1 also has a circumferentially extending planar surface 126.1 which abuts a circumferentially extending planar surface 128.1 on the abutting surface 118.1 of the pick holder.

The convex formation 122.1 has a radius of curvature 128.2 with its centre 130.1 located inwardly of the head 112.1. the concave foundation 124.1 has a radius of curvature which is substantially the same as the radius of curvature 128.2.

The pick 112.1 is rotatable within the pick holder 120.1.

Figure 2:
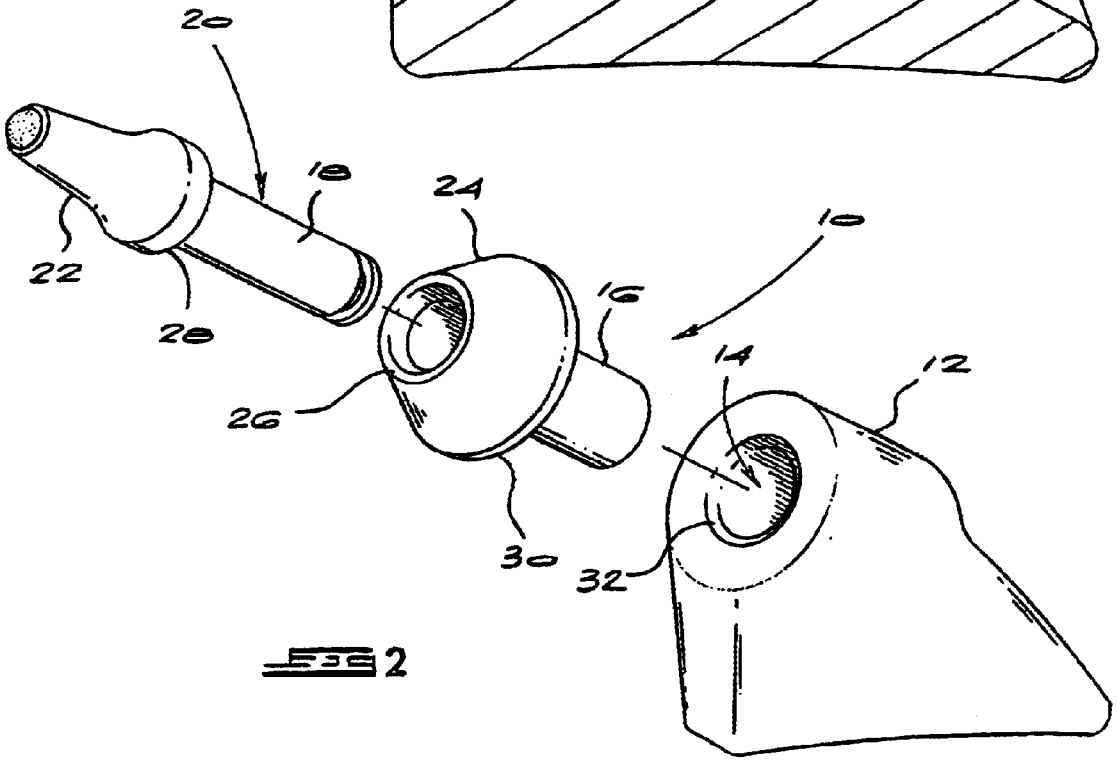
FIG. 2 is an exploded perspective view of the cutting arrangement.
Figure 10:
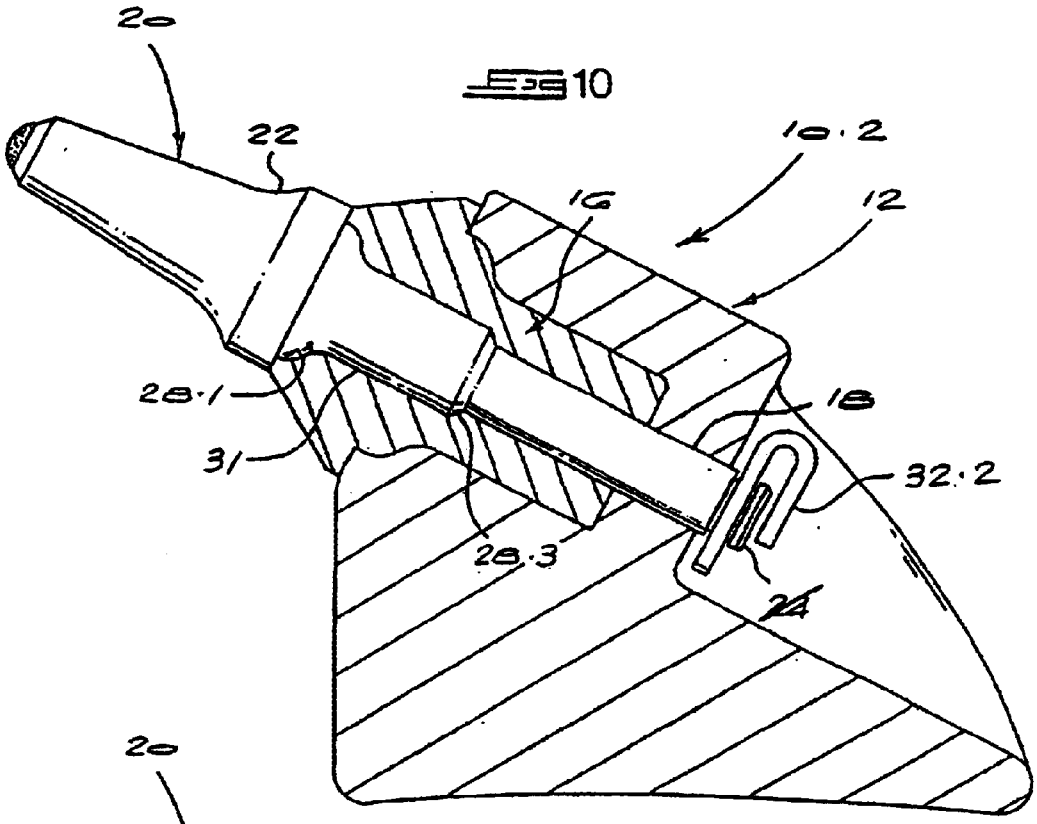
FIG. 10 is a cross-sectional side view of a cutting arrangement according to a further embodiment of the invention.
Figure 11:
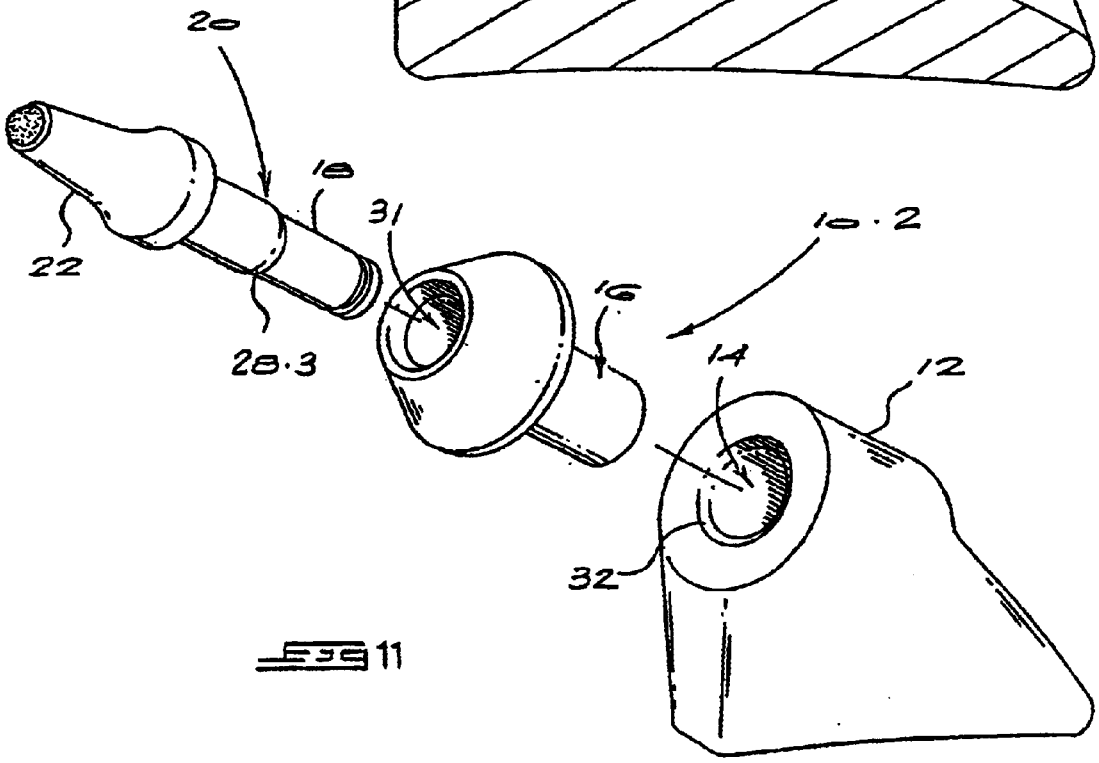
FIG. 11 is an exploded perspective view of the cutting arrangement of FIG. 10.

Referring now to FIGS. 10 and 11, a cutting arrangement 10.2 for a continuous mining machine (not shown) is the same as that shown in FIGS. 1 to 3 except that the shank 18 has 45° step formation 28.3 at which its diameter decreases. The sleeve 16 has a bore 31 which has a corresponding step formation at which the diameter of the bore 31 decreases.

A clip 32.2 retains the pick 20 within the pick holder 12. If the head 22 of the pick, which head includes the convex formation 28.1, is severed from the shank 18, the step formations on the shank and the bore 31 retain the sleeve 16 and the shank 18 within the pick holder 12 thereby preventing the loss of the sleeve 16. The clip 32.2 is removably located on the pick 20.

The step formation 28.3 is inclined at 45° and reduces the diameter of the shank by 2 mm.

Figures 12, 13:
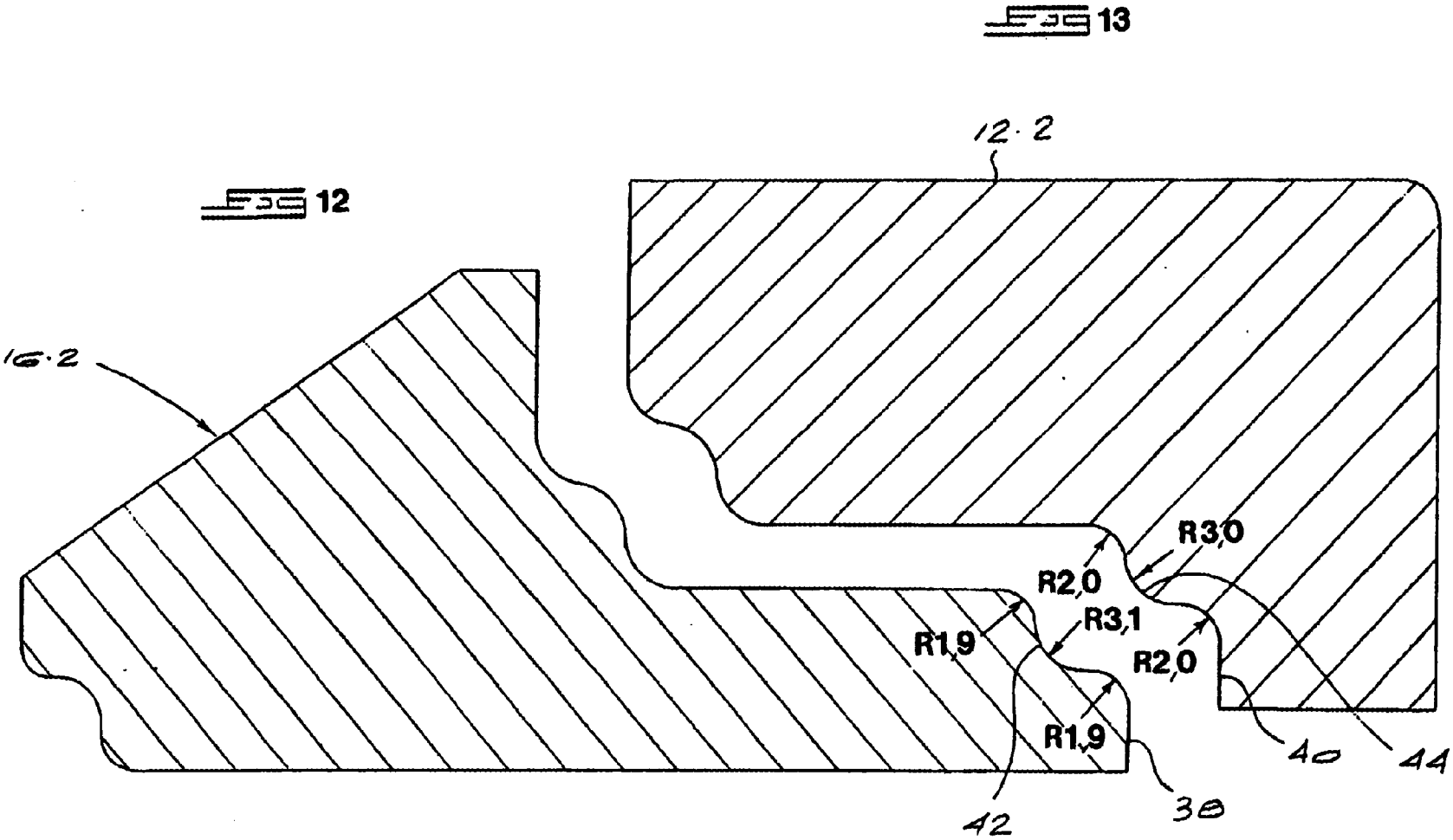
FIG. 12 is a similar view to FIG. 4, but in addition showing the curved surfaces on the tail of the sleeve.
FIG. 13 is a similar view to FIG. 5, but in addition showing the curved surfaces on the step of the pick holder.
Figure 14:
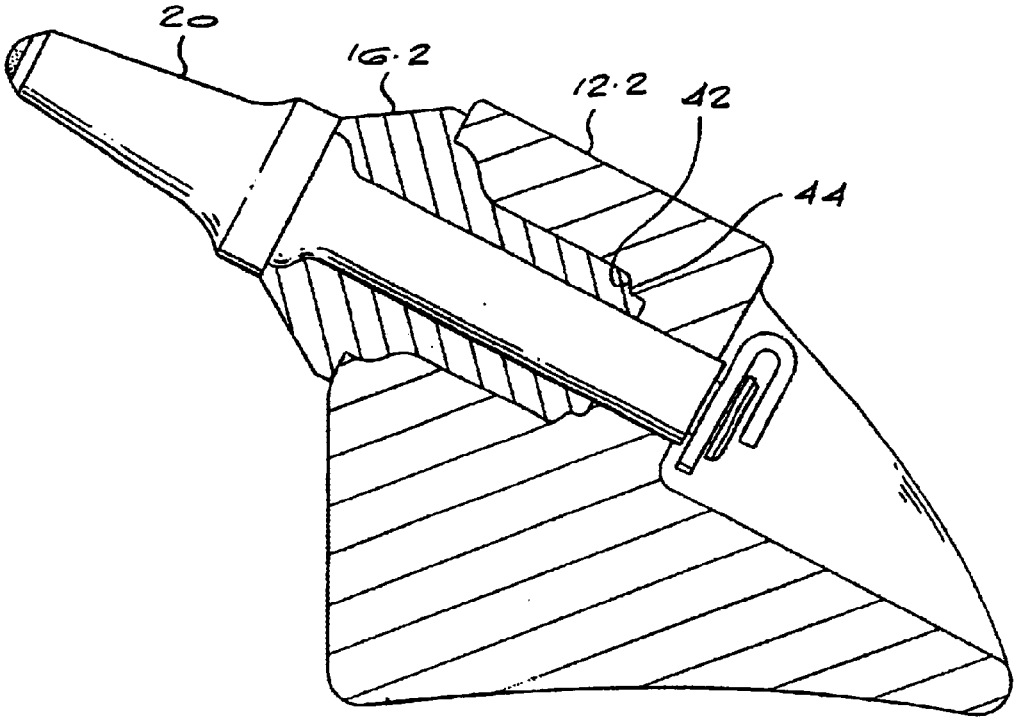
FIG. 14 is a similar view to FIG. 1, but in addition showing the curved surfaces on the tail of the sleeve and on the step of the pick holder.

Referring now to FIGS. 12 to 14, a sleeve 16.2 has a tail 38 which abuts a step 40 in the bore of the pick holder 12.2. The tail 38 has a concave formation 42 with a radius of curvature of 3.1 mm which abuts a convex formation 44 on the step 40. The convex formation 44 has a radius of curvature of 3.0 mm.

Figure 15:
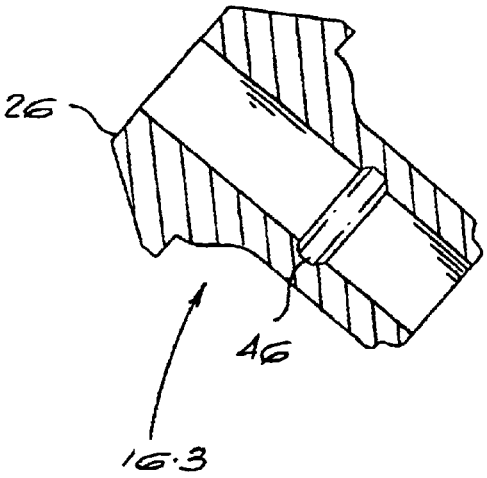
FIG. 15 is a cross-sectional side view of a sleeve according to the invention for use as an adaptor for a prior art pick.
Figure 16:
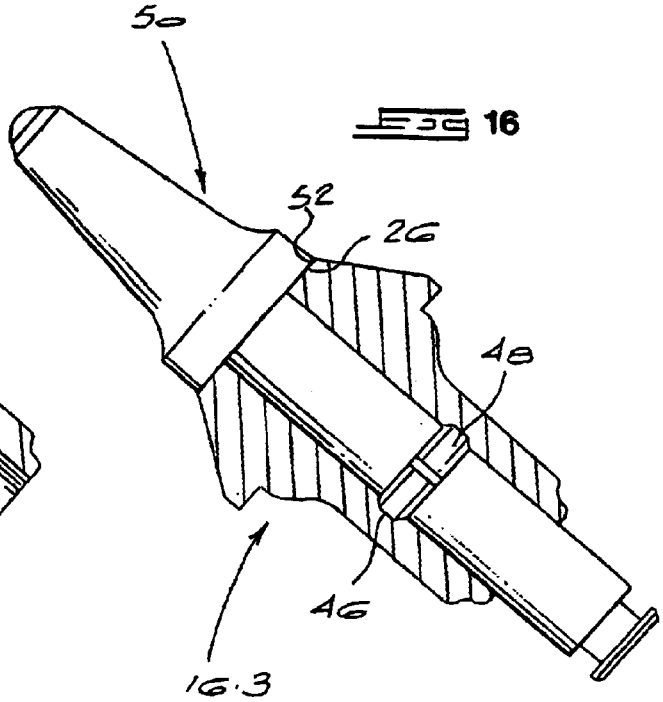
FIG. 16 is a cross-sectional side view of the prior art pick located within the sleeve of FIG. 15.

Referring now to FIGS. 15 and 16, a sleeve 16.3 is the same as sleeve 16.2 except that it does not have a convex formation on its abutting surface 26. The whole of the abutting surface 26 is planar. In addition, the bore of the sleeve 16.3 has a groove 46 for a clip 48 of a prior art pick 50. The prior art pick 50 has a planar surface 52 which abuts the planar surface 26 of the sleeve 16.3. Thus the sleeve 16.3 can be used as an adaptor in the pick holder 12.2 for a prior art pick 50.

The applicant believes that the life of a cutting arrangement according to the invention will be increased over the prior art arrangements. The reason for this is that the abutting convex and concave formations result in an increased contact area or load bearing area. The increased contact area between the abutting convex and concave formations decreases the pressure on the abutting surfaces and acts as a bearing between the abutting surfaces. The applicant also believes that the convex and concave formations will improve the rotatability of the pick within the sleeve or pick holder, and improve the rotatability of the sleeve within the bore of the pick holder because of the reduced pressure. Furthermore, the applicant believes that the convex and concave formations improve the seal between the abutting surfaces, thereby at least reducing the penetration of particulate material between the abutting surfaces. Since the sleeve is a sliding fit, and not an interference fit within the pick holder, the sleeve can easily be removed from the pick holder if it is desired to replace the sleeve.

It will be appreciated that many modifications or improvements of the invention are possible without departing from the spirit or scope of the invention. Although the invention has been described with reference to convex formations and concave formations, these formations can broadly be described as outwardly curved formations and inwardly curved formations respectively.

What is claimed is:

1. A cutting arrangement including a pick holder having a bore containing a sleeve within which a shank of a pick is located, with the pick and the sleeve each having heads, the head of the sleeve having an outer abutting surface and an inner abutting surface, the outer abutting surface abuts an abutting surface of the head of the pick, and the inner abutting surface abuts an abutting surface of the pick holder, with the abutting surface of the head of the pick having an outwardly curved formation which abuts an inwardly curved formation on the outer abutting surface of the sleeve.

2. The cutting arrangement of claim 1 wherein the inner abutting surface on the head of the sleeve has an outwardly curved formation and the abutting surface of the pick holder has an inwardly curved formation, with the inwardly and outwardly curved formations abutting one another.

3. The cutting arrangement of claim 1 wherein the abutting surface of the head of the pick and the outer abutting surface of the head of the sleeve include planar surfaces which abut one another.

4. The cutting arrangement of claim 1 wherein the inner abutting surface of the head of the sleeve and the abutting surface of the pick holder include planar surfaces which abut one another.

5. The cutting arrangement of claim 1 wherein the shank of the pick and the bore of the sleeve include retaining formations for retaining the sleeve and the shank within the pick holder if the head of the pick is severed from the shank.

6. The cutting arrangement of claim 5 wherein the retaining formations are step formations.

7. The cutting arrangement of claim 1 wherein the shank is rotatable within the sleeve and wherein the sleeve is rotatable within the bore of the pick holder.

8. The cutting arrangement of claim 1 wherein the sleeve has a tail which abuts a step in the bore of the pick holder, the tail having an inwardly curved formation which abuts an outwardly curved formation on the step.

9. The cutting arrangement of claim 1 wherein the pick is retained within the pick holder by a clip releasably secured to the pick.

10. The cutting arrangement of claim 1 wherein the outwardly curved formation is a convex formation and the inwardly curved formation is a concave formation.

11. A cutting arrangement including a pick holder having a bore containing a sleeve within which a shank of a pick is located, with the pick and the sleeve each having heads, the head of the sleeve having an outer abutting surface and an inner abutting surface, the outer abutting surface abuts an abutting surface of the head of the pick holder, with the inner abutting surface of the head of the sleeve having an outwardly curved formation interposed between inwardly curved formations and the abutting surface of the pick holder having a inwardly curved formation interposed between outwardly curved formations, with the respective inwardly and outwardly curved formations abutting one another.

12. The cutting arrangement of claim 11 wherein the outwardly curved formation is a convex formation and the inwardly curved formation is a concave formation.

13. A cutting arrangement including a pick and a pick holder, the pick having a head with a shank extending there he head having an abutting surface which abuts an abutting surface of the pick holder, the abutting surface of the head having an outwardly curved formation which abuts an inwardly curved formation on the abutting surface of the pick holder.

14. The cutting arrangement of claim 13 wherein the abutting surfaces of the pick and the pick holder include planar surface which abut one another.

15. The cutting arrangement of claim 13 wherein the shank of the pick and the bore of the pick holder including retaining formations for retaining the shank within the bore if the head is severed from the shank.

16. The cutting arrangement of claim 15 wherein the retaining formations are step formations.

17. The cutting arrangement of claim 13 wherein the outwardly curved formation is a convex formation and the inwardly curved formation is a concave formation.

18. A sleeve including an outer abutting surface for abutting a head of a pick, and an inner abutting surface for abutting a pick holder, the outer abutting surface having an inwardly curved formation for abutting an outwardly curved formation on the head of the pick.

19. The sleeve of claim 18 wherein the inner abutting surface has an outwardly curved formation for abutting an inwardly curved formation on the pick holder.

20. The sleeve of claim 18 wherein the inwardly curved formation is a concave formation and the outwardly curved formation is a convex formation.

21. The sleeve of claim 18 wherein the sleeve has a tail which abuts a step in the bore of the pick holder, the tail having an inwardly curved formation for abutting an outwardly curved formation on the step.

22. The sleeve of claim 18 wherein the sleeve has a tail for abutting a step in the bore of the pick holder, the tail having an inwardly curved formation for abutting an outwardly curved formation on the step.

23. A sleeve including an outer abutting surface for abutting a head of a pick and an inner abutting surface for abutting a pick holder, the inner abutting surface having an outwardly curved formation, interposed between inwardly curved formations, for abutting an inwardy curved formation, interposed between outwardly curved formations, on the pick holder.

24. The sleeve of claim 23 wherein the sleeve has a tail which abuts a step in the bore of the pick holder, the tail having an inwardly curved formation for abutting an outwardly curved formation on the step.

25. A pick holder including an abutting surface with an inwardly curved formation interposed between outwardly curved formations, for abutting an outwardly curved formation on a sleeve or a pick.

26. The pick holder of claim 25 wherein the inwardly curved formation is a concave formation and the outwardly curved formation is a convex formation.

27. The pick holder of claim 25 including a step in its bore for abutting a tail of the sleeve, the step having an outwardly curved formation for abutting an inwardly curved formation on the tail.

* * * * *

UNITED STATES PATENT AND TRADEMARK OFFICE

CERTIFICATE OF CORRECTION

PATENT NO. : 6,712,431 B1
DATED : March 30, 2004
INVENTOR(S) : Bosch et al.

It is certified that error appears in the above-identified patent and that said Letters Patent is hereby corrected as shown below:

Column 5,
Lines 50-51, “there he” should be -- therefrom --

Column 6,
Line 3, “surface” should be -- surfaces --
Line 36, “inwardy” should be -- inwardly --

Signed and Sealed this

Fourteenth Day of September, 2004

JON W. DUDAS
*Director of the United States Patent and Trademark Office*